United States Patent [19]

Robinson et al.

[11] Patent Number: 4,491,990

[45] Date of Patent: Jan. 8, 1985

[54] SHOWER DOOR

[75] Inventors: Thomas D. Robinson; Lewis A. Sharp, Jr., both of Nashville; George P. McAllister, Franklin, all of Tenn.

[73] Assignee: Aquaris Industries, Incorporated, Nashville, Tenn.

[21] Appl. No.: 252,868

[22] Filed: Apr. 10, 1981

[51] Int. Cl.[3] ..... A47K 3/22

[52] U.S. Cl. ..... 4/607; 4/610

[58] Field of Search ..... 4/607, 609, 610, 557

[56] References Cited

U.S. PATENT DOCUMENTS 2,021,145 11/1935 Dyar ..... 4/597
2,394,667 2/1946 Dailey ..... 4/607 X
2,518,060 8/1950 Pickles ..... 4/567
3,188,699 6/1965 Walters ..... 4/607 X

FOREIGN PATENT DOCUMENTS 0018299 4/1979 European Pat. Off. ..... 4/607

*Primary Examiner*—Henry K. Artis
*Attorney, Agent, or Firm*—Harrington A. Lackey

[57] ABSTRACT

A bubble-type shower door adapted to be pivotally mounted symmetrically about its vertical center axis to open and close a shower door opening of the same contour, the door being concave rearward and preferably having a rearward projecting diverging rim portion, and a stop flange projecting laterally from the rim on one side of the door.

7 Claims, 6 Drawing Figures

SHOWER DOOR

BACKGROUND OF THE INVENTION

This invention relates to bath closures, and more particularly to a shower bath door.

Heretofore, shower bath closures have included flexible shower curtains suspended on overhead curtain rods for slidable movement to open and close the shower area. Moreover, slidable glass shower doors have been popular in the past, and are still in use, in spite of the difficulties presented in cleaning the doors and recessed door tracks.

Other unique types of shower doors or closures are disclosed in the following U.S. Pat. Nos.:

2,021,145; Dyar; Nov. 19, 1935;
2,394,667; Dailey; Feb. 12, 1946;
2,518,060; Pickles; Aug. 8, 1950;
3,188,699; Walters; June 15, 1965.

The first three of the above cited patents disclose shower doors of a semi-cylindrical configuration suspended on overhead tracks for slidable movement in the same cylindrical path.

The above cited Walters U.S. Pat. No. 3,188,699 discloses a pair of flat glass shower doors capable of both slidable and pivotal movement.

U.S. Design Pat. No. D189,951 discloses a convex door for a steam bath cabinet hinged along one edge for opening and closing the opening into the steam cabinet.

However, none of the above patents disclose a one-piece shower door pivotally mounted about a central vertical axis within a shower cabinet door opening of the same contour, and which is capable of being mounted within the door opening of an existing shower cabinet, or which can be provided as original equipment.

SUMMARY OF THE INVENTION

It is therefore an object of this invention to provide a one-piece shower door having a peripheral configuration the same as, and adapted to mate with, the edge of a corresponding door opening, and adapted to be mounted about a vertical pivotal axis through the center portion of the door for swinging movement between closed and open positions.

A further object of this invention is to provide a dish-shaped one-piece shower door having a concave rear surface. The edges of the door terminate in a rearward projecting rim diverging rearward to provide a close fit between the rim and the existing door opening, and also to facilitate the drainage of the water collected on the interior of the door back into the shower cabinet or area.

Another object of this invention is to provide a center-hinged, dish-shaped or bubble-type, one-piece shower door having a rearward projecting rim terminating in a lateral lip flange on one side of the center-hinge axis to fit behind the corresponding edge of the door opening when the door is in closed position. The lip flange functions not only as a stop to prevent the door from swinging in one direction beyond its closed position, but also functions as a water seal between that side portion of the door and the corresponding edge of the door opening.

The shower door made in accordance with this invention is provided with upper and lower pivot pins disposed on the vertical hinge or pivotal axis of the door, each pin being adapted to be fitted through a corresponding hole in the upper and lower edges of the door opening. One of the hinge pins is retractible so that the door may be easily installed and removed from the door opening with a minimum of time, labor, tools and hardware. Such hinge pin construction permits installation of such shower doors into a door opening of the same size and shape of an existing shower cabinet.

The hinge pins may be connected by a vertical stiff rod fitted coaxially of the hinge pins and between the upper and lower rims of the door to afford reinforcement of the door, as well as providing a convenient hand-hold for the occupant of the shower cabinet.

The concave dished interior surface of the door affords additional room within the shower cabinet, as well as providing additional space, when the door is open, for the entry or exit of the occupant of the shower cabinet.

The pivotal mounting of the shower door symmetrically about a vertical center axis permits the door to be installed as a right-hand or left-hand opening door.

Moreover, the door can be pivotally mounted in a shower door opening, inside out, while being transported in order to minimize storage space requirements.

BRIEF DESCRIPTION OF THE DRAWINGS

FIG. 6 is a greatly enlarged, fragmentary section taken along the line 6—6 of FIG. 3.

DESCRIPTION OF THE PREFERRED EMBODIMENTS

Figure 1:
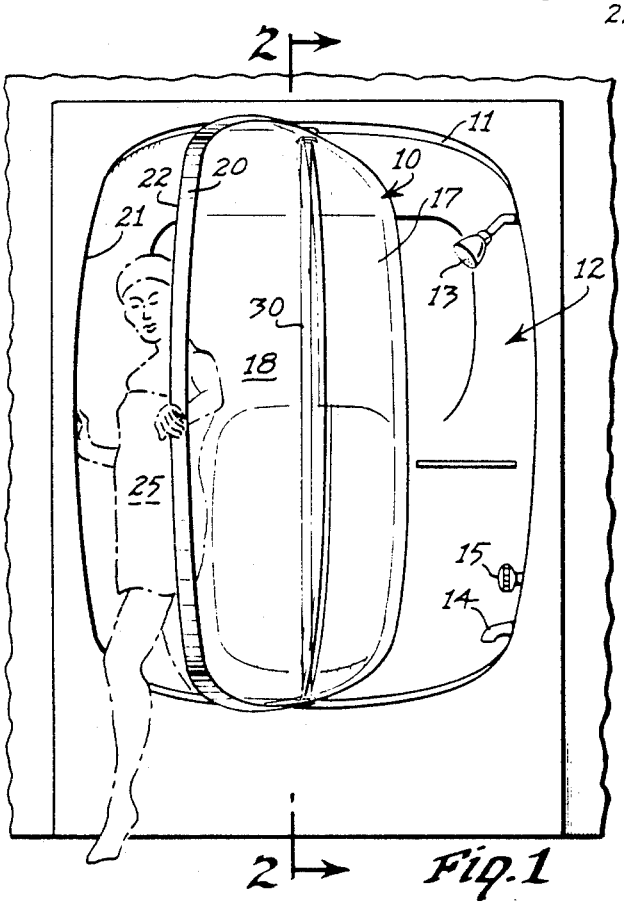
FIG. 1 is a front elevation of a shower bath cabinet including a shower door, made in accordance with this invention, in an open position.
Figure 2:
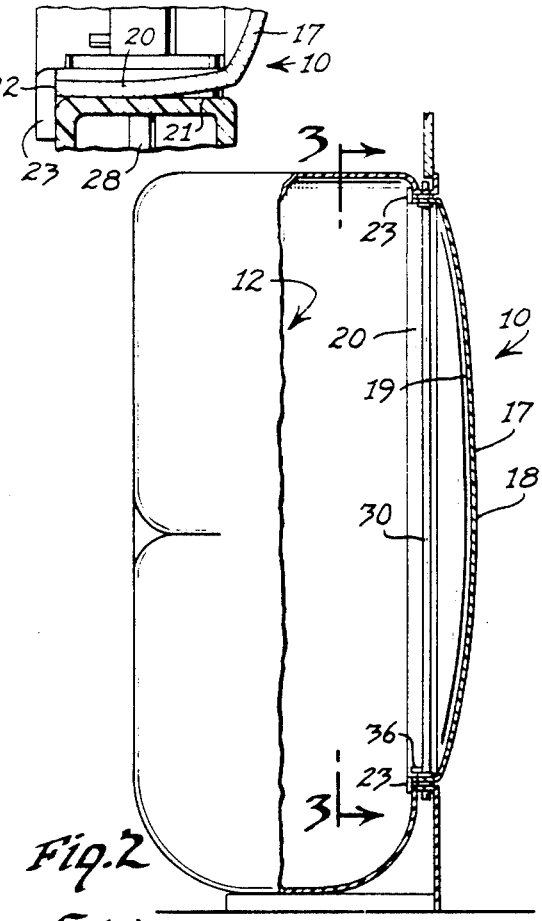
FIG. 2 is a fragmentary section taken along the line 2—2 of FIG. 1, with the shower door in closed position.

Referring now to the drawings in more detail, the shower door 10 made in accordance with this invention is adapted to close a door opening 11 in a shower bath cabinet 12, such as the disclosed molded plastic tub-shower unit, including a shower head 13, tub faucet 14, and valve control handle 15.

The door opening 11, as disclosed in the drawings, is oblong and generally rectangular, with its long axis vertical and having generally curved edges and corners. The door opening 11 is also symmetrical about its vertical center line.

The shower door 10 has the same contour as the door opening 11, and is a one-piece body preferably molded from a uniform, monolithic material. The material from which the shower door 10 is made also preferably has thermal insulating properties, not only to minimize heat loss from the shower area when the door 10 is closed, but also to minimize, if not to eliminate, condensation upon the door 10. One preferred form of door material is an acrylic resin, such as "Plexiglass."

Generally, the shower cabinet 12 will be molded from the same material as the door 10.

The contoured door body 10 includes a closure panel 17, generally dish-shaped, so that the panel 17 has a convex front or outside surface 18 and a concave rear or inside surface 19.

The peripheral or marginal edge portion of the panel 17 terminates in a substantially continuous rim 20 which projects rearward when the door 10 is closed, and expands or diverges rearward so that a substantially tight fit or seal is made between some portion of the rim 20 and the edge 21 of the door opening 11.

Moreover, it is important that the bottom rim portion 20 of the door 10 diverges rearwardly, or in other words declines rearwardly, to cause water accumulating on the rear surface 19 of the panel 17 to drain rearward into the shower cabinet 12, while the door 10 is closed.

The rim 20 terminates in a free rear edge 22, with the exception that the rim 20 on one side of the center line of the door 10 merges, or is integrally formed with, a lateral lip flange 23 projecting away from the center line. The lip flange 23 is adapted to project outward substantially parallel to the plane of the door opening 11 and extend behind the corresponding edge 21 of the door opening 11. Moreover, the lip flange 23 is adapted to fit substantially flush against the inner surface 24 of the edge portion of the door opening 11, when the door 10 is closed, in order to effect a substantially water-tight seal between the door 10 and the opening 11 along one side of the door 10.

In the preferred form of the invention, the lip flange 23 should be on the side portion of the door 10 which is at the same end of the shower cabinet 12 as the bath fixtures 13, 14 and 15. Since the function of the lip flange 23 is also as a stop to prevent that side of the door from moving forward past the closed position, then the occupant of the shower cabinet 12, or the bather 25, must enter and exit from the opposite end of the shower cabinet 12, away from the shower fixtures.

The shower door 10 is pivotally mounted about its longitudinal center line by means of a pair of upper and lower hinge pins 27 and 28, which extend upward and downward coaxially from the upper and lower edge portions of the door 10.

The upper hinge pin 27 may be fixedly mounted in the upper end of an elongated vertical support rod 30, and extend upward through registering apertures in a pair of bearing plates 31 and 32 on opposite sides of a flattened rim portion 33. The hinge pin 27 is then adapted to be inserted through a corresonding hole 34 in the edge 21 of the door opening 11, which hole 34 functions as a rotary bearing for the hinge pin 27.

The bottom or lower hinge pin 28 is fixed coaxially to a cylindrical slide body 35 vertically slidable within the lower end portion of the support rod 30. The slide body 35 is provided with a radially projecting handle 36 slidable within a vertical elongated slot 37 to permit retractible movement of the pin 28.

Figure 5:
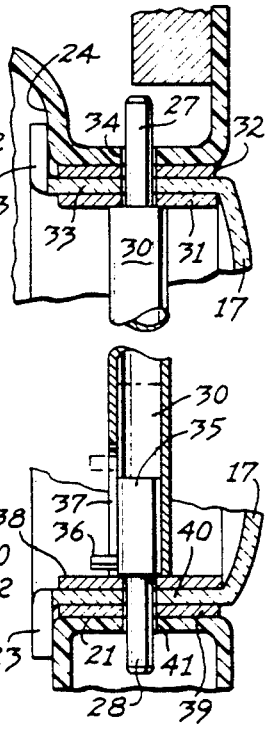
FIG. 5 is a fragmentary section taken along the line 5—5 of FIG. 4.

As disclosed in FIG. 5, the lower hinge pin 28 projects through corresponding registering openings in lower bearing plates 38 and 38, between which are sandwiched the lower flattened rim portion 40. The pin 28, in its lowermost position, projects through a corresponding pin hole 41 in the lower edge 21 of the door opening 11. The hole 41 also functions as a rotary bearing for the hinge pin 28.

Thus, in order to either assemble or disassemble the door 10 from the opening 11, it is merely necessary to grasp the handle 36 and retract upward the slide body 35 and pin 28. The upper pin 27 is thrust upward through the corresponding apertures and the pin hole 34. After the retracted pin 28 is in registry with its corresponding hole 41, the handle 36 is thrust downward causing the pin 28 to latch in its pivotally supported position. Thus, the door 10 is pivotally mounted, without any further utilization of tools or hardware.

Moreover, it is noted that the one-piece door 10 requires no frame or hardware, other than the above described hinge pins 27 and 28. The washers or wear plates 31, 32 and 38 and 39 are optional.

Moreover, the reinforcing support bar 30 is optional, since the hinge pins 27 and 28 could be mounted independently in the upper and lower rim portions 33 and 40.

It is thus apparent that the door 10 along with the pivotal mounting hardware, including the hinge pins 27 and 28 and their supporting structure, can be easily mounted within the door opening 11 of an existing shower bath cabinet 12, by merely drilling the upper and lower pin holes 34 and 41.

Figure 3:
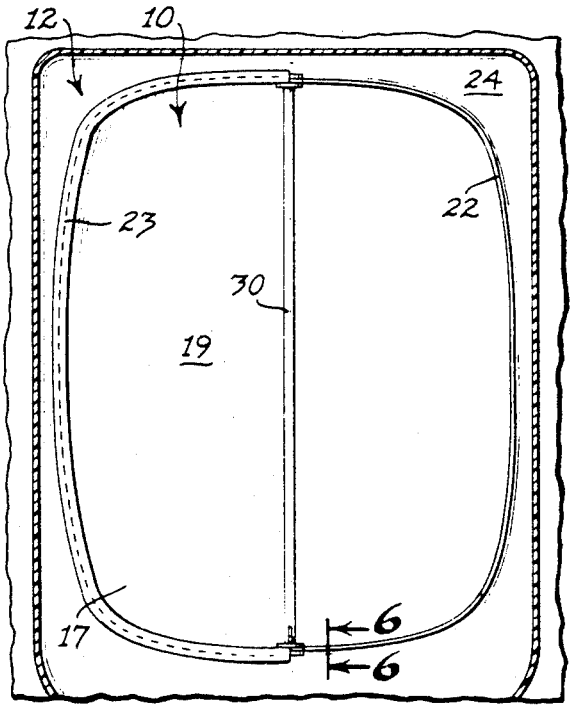
FIG. 3 is a sectional elevation taken along the line 3—3 of FIG. 2 illustrating the rear or interior surface of the door in closed position.
Figure 4:
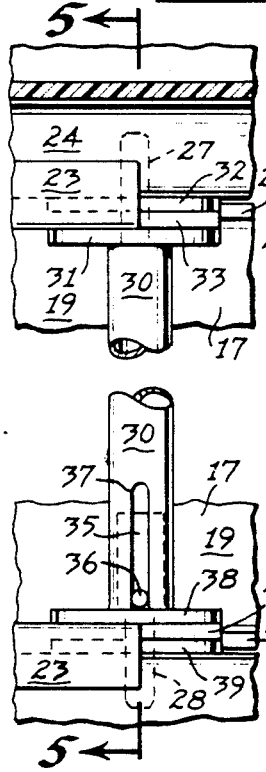
FIG. 4 is a greatly enlarged, fragmentary, rear elevational section of the hinge supports for the door in closed position.

Since the door and hinge pin structure 27 and 28 are symmetrical about the vertical center line of the door 10, the door may be mounted either in a right-side up position, as disclosed in FIGS. 1 and 3, or an upside-down position if the bath fixtures 13–15 are at the opposite or left end of the cabinet 12, as disclosed in FIG. 1. When the door 10 is mounted in the upside-down position, then the lip flange 23 will abut behind the edge 21 at the left of the door opening 11.

the exterior front surface 17 is formed in a convex shape corresponding with the concave rear surface 19, not only because of ease of manufacture, but also to enhance the appearance of the door.

The one-piece construction of the door 10 eliminates seals and joints, which are difficult to clean, as well as facilitates manufacture.

The one-piece construction of the door 10 also eliminates any need for a frame of any type, which would increase the cost of materials and time for manufacture of the door.

The pivotal mounting of the door 10 about its vertical center axis provides a balanced mounting for the door 10, facilitating the opening and closing of the door by the bather 25. The weight of the door 10 is substantially equally balanced on opposite sides of the pivotal center axis.

It is also within the scope of this invention to either eliminate the support rod 30 or to provide a support rod 30 which is not straight, but more nearly conforms to the curvature of the rear door surface 19, thereby providing more room between the interior of the door and the interior of the cabinet 12. Thus, when the door 10 is open, the entry and exit passage through the door opening 11 is extended by the lateral distance between the vertical axis and the rear surface 19 of the door 10. With or without the support 30, additional space is provided by the concave shape of the interior or rear surface 19 of the door 10 within the shower cabinet 12, except where the vertical support rod 30 is encountered.

The lip flange 23, when sealed against the inner surface 24 of the door opening 11, when the door 10 is in closed position, provides a very secure water seal for approximately one-half the perimeter of the door 10, and particularly that side of the door which is at the same end of the shower cabinet 12 as the shower head 13, where most of the water is encountered.

Moreover, since the lip flange 23 functions as a stop, the door 10 can be opened forward in only one direction, and that is at the opposite end of the shower from the shower fixtures, as best disclosed in FIG. 1. Thus, a shower cabinet 12 will always be entered on the opposite end of the shower from the shower fixtures.

Even the flared rim portion 20 without the lip flange 23, constitutes an adequate seal against the inner edge 21 of the door opening 11, at the end of the shower cabinet 12 where lesser amounts of water and spray are encountered.

The material from which the shower door 10 is manufactured or molded may be transparent, translucent, or opaque, and manufactured in various colors, in a manner well-known in the plastics arts.

Another advantage of pivotally mounting the door 10 about its vertical center axis, is that even with the door 10 in its extreme open position, only one half of the door projects forward from the door opening 11 into the bathroom area, while the opposite side of the door projects rearward into the cabinet or shower area, no longer occupied by the bather 25.

It will be understood that the shower door 10 may be mounted, not only in a tub-shower unit, such as that disclosed in the drawings, but can also be installed in the door opening of the same contour of a shower cabinet, not including a tub, or in a cabinet provided with steam bath fixtures or whirlpool fixtures.

Moreover, the construction of the door 10 to conform to the contour of the door opening 11 of the shower unit 12 permits the shower area to be completely confined, when the door 10 is closed, thereby minimizing the discharge of humidity and steam from the shower area into the rest of the bathroom. Even when the door 10 is open to permit the egress of the bather 25, the door can be quickly re-closed to confine the vapor within the shower area until condensed or discharged through the drain of the shower unit 12.

We claim:

1. In a shower bath cabinet including a door opening having a fixed edge of predetermined contour, a shower door comprising:

(a) a one-piece body including a dished closure panel having a peripheral edge portion of the same shape as the contoured edged of the door opening to be closed by said door, (b) said closure panel also having a front surface, a concave rear surface, top and bottom portions and first and second opposite side portions, (c) said edge portion comprising a substantially continuous rim, including first and second opposed side rim portions, projecting rearward from said closure panel and terminating in a free peripheral edge and (d) pivotal support means on the top and bottom portions of said body for attaching said body to the fixed edge of the door opening in operative position for pivotal movement of said body about a fixed vertical axis in the door opening (extending) spaced between said first and second side rim portions so that said body may swing between a closed position in which said body closes the door opening and said vertical axis is spaced behind said concave rear surface, and an open position in which one side portion of said body swings behind the door opening and the other side portion swings in front of the door opening, and (e) one of said side rim portions being adapted to engage the corresponding edge of the door opening when in said closed position to limit the swinging movement of said panel away from said open position.

2. The invention according to claim 1 in which at least the major portion of the bottom rim portion declines rearward.

3. The invention according to claim 1 in which the door opening is symmetrical about a vertical center line, said vertical pivot axis coinciding with said center line so that the first and second side portions of said body are balanced about said vertical pivot axis in said operative position.

4. The invention according to claim 3 in which said pivotal support means comprises an upper hinge pin projecting upward from the top rim for registering with a corresponding hole in the upper edge of the door opening and a lower hinge pin projecting downward from the bottom rim for registering with a corresponding hole in the bottom edge of the door opening, and means for retracting one of said pins coaxially of the pivot axis to facilitate assembly and disassembly of said door in the door opening.

5. The invention according to claim 4 further comprising an elongated rigid rod extending between said upper and lower rim portions coaxially of said vertical pivot axis and spaced from said concave rear surface to function as a reinforcing bar for said one-piece body and also a hand-hold for an occupant of the shower bath cabinet.

6. The invention according to claim 1 further comprising a lip flange projecting from the rear edge of the rim on the first side portion of said body in a lateral direction away from said vertical pivot axis to engage behind a corresponding edge of the door opening, in closed position.

7. The invention according to claim 6 in which said first side portion of said body is located at the same end of the shower cabinet as the shower head.

* * * * *